United States Patent [19]

Tanaka et al.

[11] Patent Number: 4,590,783

[45] Date of Patent: May 27, 1986

[54] PRESS FORMING PROCESS AND APPARATUS THEREFOR

[75] Inventors: Hiroshi Tanaka, Fujisawa; Sotozi Mitani, Sagamihara; Yasushi Sakurai, Yokohama, all of Japan

[73] Assignee: Nissan Motor Co., Ltd., Yokohama, Japan

[21] Appl. No.: 693,986

[22] Filed: Jan. 23, 1985

[30] Foreign Application Priority Data

Jan. 25, 1984 [JP] Japan ..... 59-10245

[51] Int. Cl.[4] ..... B21D 17/02

[52] U.S. Cl. ..... 72/384; 72/348; 72/414; 72/404; 72/472; 72/379

[58] Field of Search ..... 72/348, 414, 418, 384, 72/381, 385, 386, 389, 404, 472, 411, 379

[56] References Cited

U.S. PATENT DOCUMENTS

| | | | |
|---|---|---|---|
| 2,670,527 | 3/1954 | Roper | 72/379 |
| 3,307,387 | 3/1967 | Lacey, Jr. et al. | 72/379 |
| 3,491,573 | 1/1970 | Tennison, Jr. | 72/379 |
| 3,908,435 | 9/1975 | Bowman, Jr. et al. | 72/411 |
| 4,413,495 | 11/1983 | Peuhkurinen et al. | 72/379 |
| 4,509,357 | 4/1985 | Zbornik | 72/384 |

FOREIGN PATENT DOCUMENTS

| | | | |
|---|---|---|---|
| 38708 | 10/1978 | Japan | 72/389 |

*Primary Examiner*—Francis S. Husar
*Assistant Examiner*—David B. Jones
*Attorney, Agent, or Firm*—Schwartz, Jeffery, Schwaab, Mack, Blumenthal & Evans

[57] ABSTRACT

A press forming process is composed of a step of removing wrinkles of the surface of a curved elongate flat sheet metal workpiece which has been prepared by a so-called edge bending process. The wrinkle removing step is carried out prior to a U-shape bending step in which the workpiece is bent to have a U-shaped cross-section in order to obtain an curved elongate channel-shaped article, thereby improving the quality of the resulting article while preventing press dies from being damaged.

9 Claims, 8 Drawing Figures

PRESS FORMING PROCESS AND APPARATUS THEREFOR

BACKGROUND OF THE INVENTION

1. Field of the Invention

This invention relates to a press forming process for bending a sheet metal workpiece to obtain a curved elongate channel-shaped article such as an automobile frame while removing wrinkles which have been formed on the surface of the workpiece in a previous bending process.

2. Description of the Prior Art

In connection with press forming processes for automobile frames and the like, a so-called edge bending process is carried out to bend a flat elongate workpiece into a curved elongate workpiece prior to a press forming process to obtain a curved elongate channel-shaped frame. It is to be noted that wrinkles are inevitably formed on the surface of the workpiece in the edge bending process. These wrinkles not only remain unremoved after the press forming process on the surface of the workpiece, but also give rise to problems in which wear of press dies at portions corresponding to the wrinkles of the workpiece is promoted thereby causing galling and seizure of the press dies.

SUMMARY OF THE INVENTION

A first aspect of the present invention is to provide a press forming process for producing a curved elongate channel-shaped article. The process is composed of a wrinkle removing step to remove wrinkles formed on the surface of a curved elongate flat sheet metal workpiece which has been prepared by an edge bending process. The wrinkle removing step is carried out prior to a U-shape bending step to obtain the curved elongate channel shaped article. Therefore, no wrinkle remains unremoved on the surface of the article while preventing press dies from promoted wear, galling and seizure, thereby improving surface quality of the article and prolonging the life of the press dies.

A second aspect of the present invention is to provide a press forming apparatus for achieving the above-mentioned press forming process. The apparatus is composed of upper and lower press elements associated with each other to accomplish press forming of the workpiece. The upper and lower press elements include both a wrinkle removing device for removing wrinkles of the workpiece, and a U-shape bending device to accomplish the U-shape bending of the workpiece. Therefore, wrinkle removing can be achieved simultaneously with the U-shape bending in the same press forming apparatus, thereby effectively removing the wrinkles of the workpiece without increasing operation steps.

BRIEF DESCRIPTION OF THE DRAWINGS

The features and advantages of the press forming process and the apparatus therefor according to the present invention will be more clearly appreciated from the following description taken in conjunction with the accompanying drawings in which like reference numerals designate corresponding elements, and in which.

DETAILED DESCRIPTION OF THE INVENTION

Figure 1:
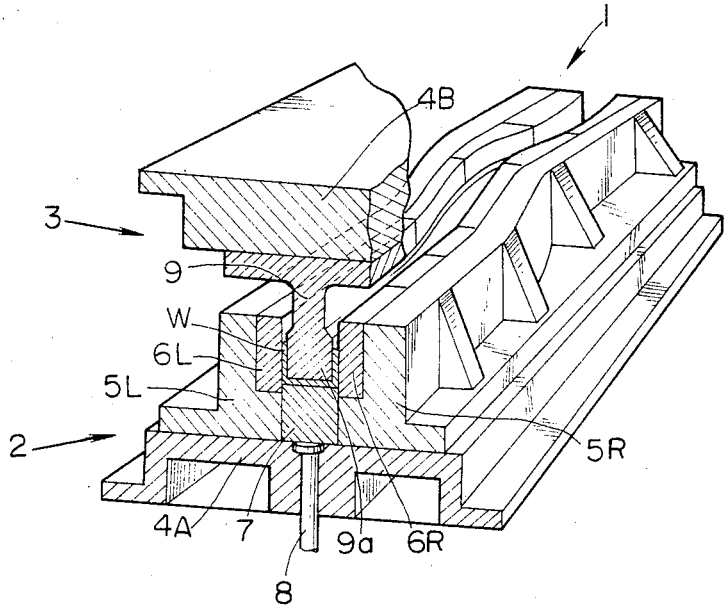
FIG.1 (PRIOR ART)
FIG. 1 is a perspective view, partly in section, of an essential part of a conventional press forming apparatus.
Figure 2A:
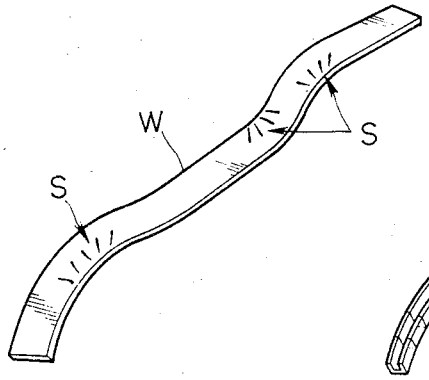
FIG. 2A is a perspective view of a curved elongate sheet metal workpiece after an edge bending process, showing wrinkles formed on the surface of the workpiece.

To facilitate understanding the present invention, a brief reference will be made to a conventional press forming apparatus, depicted in FIG. 1, by which a curved elongate flat sheet metal (referred hereinafter to as a "workpiece W") is bent to have a U-shaped cross-section providing a desired curvature in order to obtain, for example, channel-shaped frames for automotive vehicles. The curved elongate flat sheet metal has been already prepared usually by a so-called edge bending process in which, for example, a die having a curved surface is pressed against the edge of a straight elongate sheet metal to bend it as shown in FIG. 2A. Referring to FIG. 1, the conventional press forming apparatus is equipped with a press element assembly 1 which is made up of lower and upper press elements 2, 3. The lower press element 2 includes a lower holder 4A on which auxiliary holders 5L, 5R are fixedly mounted. The auxiliary holders 5L, 5R are provided at their opposite inner upper sections with U-shape bending press dies 6L, 6R, respectively. Interposed between the auxiliary holders 5L, 5R with the U-shape bending press dies 6L, 6R is a pad 7 which is movable in a vertical direction. The pad 7 is always biased upwardly by a plurality of cushion pins 8. An auxiliary punch holder 9 is fixedly installed to an upper holder 4B of the upper press element 3 and formed with a punch section **9*a***.

Figure 2B:
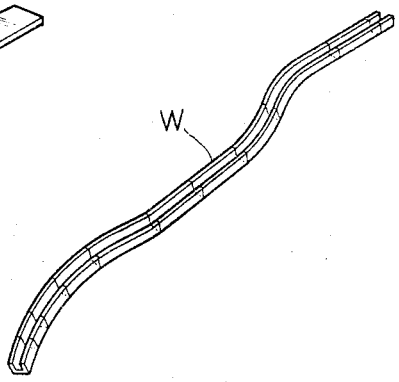
FIG. 2B is a perspective view of a curved elongate channel-shaped article after a U-shaped bending process.

With the thus arranged conventional press forming apparatus, a press forming is carried out as follows: First, the workpiece W is placed on the pad 7 at its upper-most position. The thus placed workpiece W is put between the punch section **9*a* of the auxiliary punch holder 9 and the pad 7 under the action of a descending ram (not shown), and thereafter forced into between the U-shape bending press dies 6L, 6R against the biasing force of the cushion pins 8. When the lower surface of the pad 7 reaches the lower holder 4A, the workpiece W is bent to have a U-shaped cross-section with a desired curvature as shown in FIG. 2B. Subsequently, when the ram is ascended, the punch section 9*a* is restored to its original upper-most position. Then, the workpiece W which has been completed in the press forming is pushed up by the pad 7 under the bias of the cushion pins 8, thus being taken out of the U-shape bending press dies 6L, 6R**.

However, in such a press forming process using the conventional press forming apparatus, although only U-shape forming of the workpiece W is accomplished to obtain a channel-shaped article (as shown in FIG. 2B) having a U-shaped cross-section, removing uneven wrinkles S (as shown in FIG. 2A) formed on the surface of the workpiece W cannot be accomplished which wrinkles have been formed on the edge bending process. Therefore, not only the wrinkles remain unremoved on the surface of the workpiece W even after the press forming process, but also wear of the press dies at portions corresponding to the wrinkles of the workpiece W is noticeably promoted, thereby causing galling and seizure of the press dies.

Figure 3:
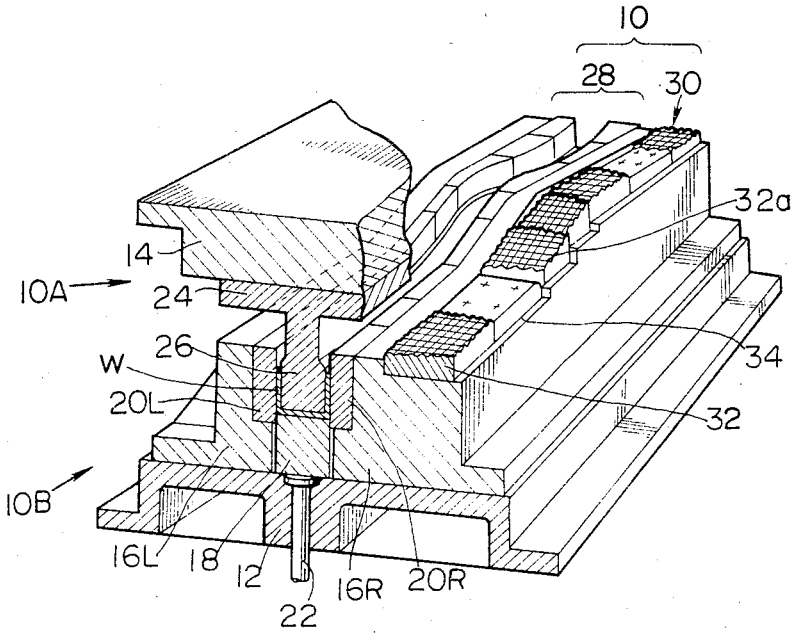
FIG. 3 is a perspective view, partly in section, of an essential part of a press forming apparatus for achieving a press forming process of the present invention.
Figure 4:
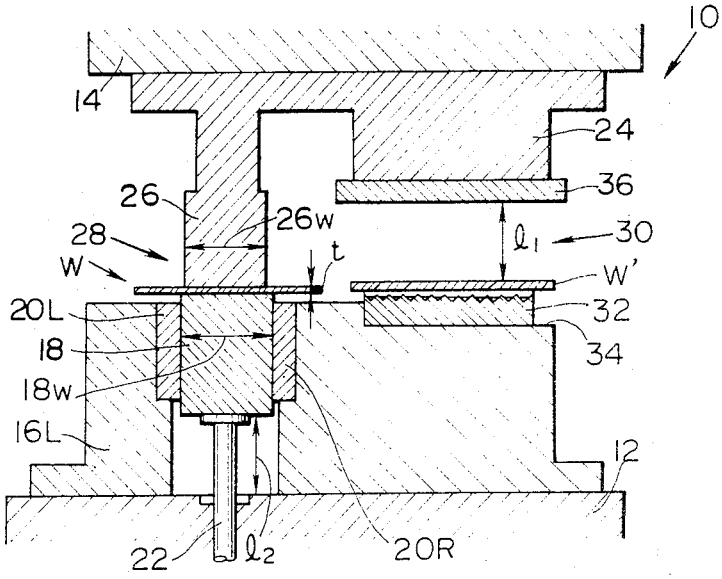
FIG. 4 is a vertical sectional view of the essential part of the press forming apparatus of FIG. 3, showing a state wherein a workpiece (W) is placed in position and put between a punch section and a pad while another workpiece (W') is placed on a punch plate.

In view of the above description of the conventional press forming apparatus and process, reference is now made to FIGS. 3, 4 and 5A to 5C, and more specifically to FIGS. 3 and 4, wherein a preferred embodiment of a press forming apparatus of the present invention is illustrated by the reference numeral 10. The press forming apparatus of this embodiment is for producing a curved elongate channel-shaped article, as shown in FIG. 2B, such as a frame of an automotive vehicle and the like. The press forming apparatus 10 comprises upper and lower press elements 10A, 10B which respectively include upper and lower holders 12, 14. The upper and lower holders 12, 14 are oppositely disposed and movable in such a manner as to approach and separate from each other. Auxiliary holders 16L, 16R are fixedly mounted on the lower holder 12 and spaced from each other to define therebetween a space (no numeral) for a movable pad 18. Press dies 20L, 20R are securely held respectively by the auxiliary holders 16L, 16R at their upper inner sections. The pad 18 is slidably interposed between the press dies 20L, 20R, and movable upwardly and downwardly under the biasing force of a plurality of cushion pins 22 which always bias the pad 18 upwardly.

A punch holder 24 is fixedly installed to the lower surface of the upper holder 14 and provided with a punch section 26 which is insertable into between the press dies 20L, 20R to push down the pad 18. The punch section 26 is formed into the shape, at its lower and side surfaces, corresponding to the pad 18. The punch section 26 has a width 26*w* is smaller than that 18*w* of the pad 18 by a value of about two times the thickness t of the workpiece W. It will be understood that when the punch section 26 is inserted between the opposing press dies 20L, 20R, a clearance for the workpiece W is formed between the inner surface of the press die and the side surface of the punch section 26. The thus configurated punch section 26, press dies 20L, 20R, and pad 18 form part of a U-shape bending device or means 28 which accomplishes bending the workpiece W or the curved elongate sheet metal as shown in FIG. 2A to obtain a curved channel-shaped article as shown in FIG. 2B.

The press forming apparatus 1 is further provided with a wrinkle removing device or means 30 which includes a plurality of punch plates 32 located in a line as shown in FIG. 3. The punch plates 32 are securely placed on step sections 34 formed on the auxiliary holder 16R at a linear location generally parallel with and adjacent the press die 20R. The auxiliary holder 16R is laterally elongated as compared with the auxiliary holder 16L in order to form the step section 34 for the punch plates 32. The auxiliary holder 16R is fixedly mounted on the holder 12 at the right side relative to the cushion pins 22 in FIG. 3, the right side being laterally elongated as compared with the left side relative to the cusion pins for the purpose of mounting thereon the laterally elongated auxiliary holder 16R.

Figure 5A:
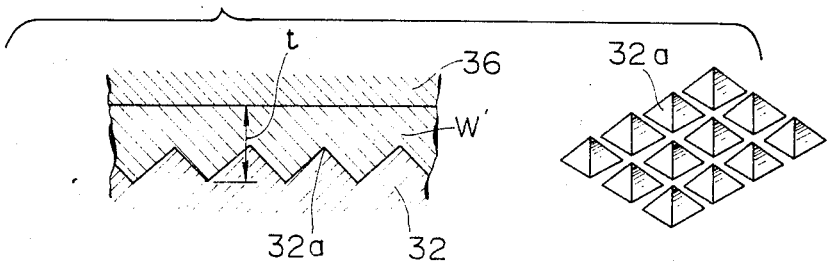
FIGS. 5A to 5C are views of a variety of types of projections formed on the punch plate of FIG. 4, in which each left side figure is a vertical sectional view indicating a state in which a press forming for removing wrinkles is completed under the action of the projection of the punch plate and a press plate, while each right side figure is a perspective view indicating the shape and arrangement of the projections.
Figure 5B:
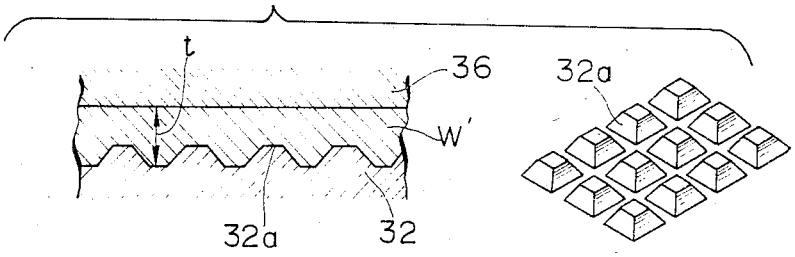
Figure 5C:
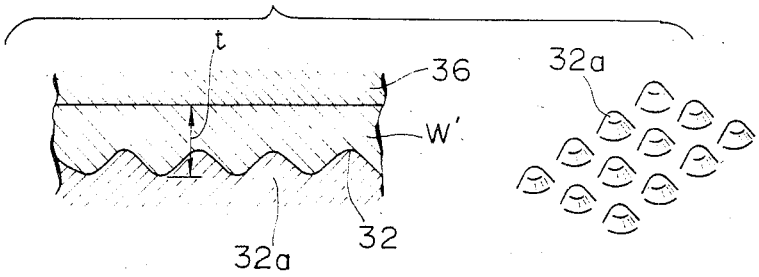

Each of the punch plates 32 disposed at the locations corresponding to the wrinkles S formed on the workpiece W is provided at its upper surface with a plurality of closely disposed projections 32*a*. FIGS. 5A to 5C reveal a variety of the projections 32*a* in which FIGS. 5A, 5B and 5C indicate the projections 32*a* of the types of quadrangular pyramid, frustum of a pyramid, and cone having a rounded top, respectively. It will be understood that a suitable type of projections 32*a* is selected in accordance with wrinkle formation characteristics. Disposed at the locations corresponding to the portions of the workpiece W where no wrinkles are formed are the punch plates 32 which have a flat upper surface without any projections. The punch plates 32 may be otherwise installed to the side of the upper holder 14 according to conditions.

The upper holder 14 is laterally elongated corresponding to the lower holder 12. A press plate 36 is installed through the auxiliary holder 24 to the upper holder 14 and located to face the punch plates 32. It is to be noted the distance $l_1$ between the lower surface of the press plate 36 and the upper surface of a workpiece W′ placed on the punch plates 32 is adjusted to be approximately equal to the distance $l_2$ of a stroke of the pad 18 in a state where the punch section 26 is brought into contact with the workpiece W placed on the pad 18 at its upper-most position. The workpiece W′ is a curved elongate sheet metal, as shown in FIG. 2A, which has been prepared from an straight elongate sheet metal by the edge bending process.

The press forming process using the thus arranged apparatus will be hereinafter discussed.

As shown in FIG. 4, the workpiece W′ which has been subjected to the edge bending process is placed on the punch plates 32, while another workpiece W whose wrinkles have been removed by the wrinkle removing device 30 is placed on the pad 18 at its upper-most position. When a ram (not shown) connected to the upper holder 14 is descended, the workpiece W is put between the punch section 26 and the pad 18 and then is forced into between the press dies 20L, 20R, so that the U-shape bending of the workpiece W is completed at the lower-most position of the pad 18 where the pad is brought into contact with the lower holder 12, thereby obtaining the curved channel-shaped article having a U-shaped cross-section as shown in FIG. 2B. Simultaneously, the press plate 36 causes the workpiece W′ to be pressed against the punch plates 32, and accordingly unevenness is formed on desired portions of the workpiece W′ removing the wrinkles S which have been formed on the surface of the workpiece W′ in the edge bending process, thus accomplishing a primary forming with a desired curvature.

Thereafter, the ram is ascended to cause the upper holder 14 to move upwardly in which the punch section 26 is restored to its original upper-most position. Then, the workpiece W (as shown in FIG. 2A) which just has been subjected to the U-shape bending is pushed out of the press dies 20L, 20R under the action of the pad 18 pushed up by the cushion pins 22, and therefore removed to the next step (not explained). At the same time, the workpiece W′ which just has been subjected to the primary forming is removed onto the pad 18 to be subjected to the U-shape bending. A new workpiece (as shown in FIG. 2A) which has been subjected to the edge bending process is placed on the punch plates 32 to be subjected to the primary forming. While the punch plates 32 have been shown and described as being installed to a common auxiliary holder 16R to which the press die 20R for the U-shaped bending is also installed, it will be understood that the punch plates 32 may be installed to the other holder to which the press die 20R is not installed.

As will be appreciated from the above discussion, according to the present invention, removing wrinkles formed on the surface of the workpiece in the edge bending process is carried out prior to the U-shape bending of the workpiece. This is accomplished by providing the wrinkle removing device adjacent the U-shape bending device. Additionally, the wrinkle removing device and the U-shape bending device are arranged to be operated by the same upper and lower holders, and therefore the wrinkle removing can be accomplished prior to the U-shaped bending without increasing operation steps while accomplishing the primary forming of the curved elongate sheet metal. This leads to achievement of smooth U-shape bending, thereby greatly improving surface quality obtained in press forming of automotive vehicle frames and the like.

What is claimed is:

1. A press forming process for producing curved elongate channel-shaped articles, said process comprising the step of simultaneously performing a single pressing movement to effect a wrinkle removal step and a bending step by using a single upper press element of a press forming apparatus, said wrinkle removing step removing wrinkles formed on a surface of a first curved elongate flat sheet metal workpiece which is prepared by an edge bending process in which the wrinkles are formed, and said bending step bending a second wrinkle-free curved elongate sheet metal workpiece which has been previously subjected to said wrinkle removal step, to obtain the curved elongate channel-shaped article.

2. A press forming process as claimed in claim 1, wherein said removing wrinkles includes pressing said curved elongate flat sheet metal on a punch plate which is provided at its surface with a plurality of closely disposed projections.

3. A press forming process as claimed in claim 1, wherein said bending includes pressing a punch onto said curved elongate flat sheet metal so as to bias said curved elongate flat sheet metal against a surface of a press die.

4. A press forming apparatus for producing a curved elongate channel-shaped article, said apparatus comprising:

a lower press element;

an upper press element movable and adaptable with said lower press element to form a press;

means for removing wrinkles formed on a surface of a curved elongate flat sheet metal which is prepared by an edge bending process in which the wrinkles are formed, said removing means including a first upper pressure member forming part of said upper press element; and means for bending said curved elongate flat sheet metal, after wrinkles are removed by said removing means, to obtain the curved elongate channel-shaped article, said bending means including a second upper pressure member forming part of said upper press element, said first and second upper pressure members of said removing means and said bending means being in stationary relation with each other and operative as a one-piece body.

5. A press forming apparatus as claimed in claim 4, wherein said wrinkle removing means includes a punch plate securely connected to a first lower holder member and provided at its surface with a plurality of closely disposed projections, and a press plate securely connected to an upper holder member and located opposite to said punch plate, said curved elongate flat sheet metal being placed on said punch plate to be pressed on said punch plate by said press plate.

6. A press forming apparatus as claimed in claim 5, wherein said bending means includes a punch securely connected to said upper holder member, first and second press dies which are securely installed to said first lower holder and a second lower holder, respectively, and oppositely disposed to define therebetween a space, and a pad member located opposite to said punch and vertically movably disposed in said space, said pad member being always biased upwardly toward said punch, said curved elongate flat sheet metal being placed on said pad member to be pressed against said first and second press dies and said pad member at its lower-most position.

7. A press forming apparatus for producing a curved elongate channel-shaped article, said apparatus comprising:

an upper lower press element;

a upper press element associated with said upper press element so as to be brought into contact with each other under pressure;

means for removing wrinkles formed on a surface of a curved elongate flat sheet metal which is prepared by an edge bending process in which the wrinkles are formed, said removing means forming part of upper and lower press elements, and including a punch plate securely connected to a first lower holder member and provided at its surface with a plurality of closely disposed projections, and a press plate securely connected to an upper holder member and located opposite to said punch plate, said curved elongate flat sheet metal being placed on said punch plate to be pressed on said punch plate by said press plate; and means for bending said curved elongate flat sheet metal, after wrinkles are removed, to obtain the curved elongate channel-shaped article said bending means forming part of said upper and lower press elements, wherein said bending means includes a punch securely connected to said upper holder member, first and second press dies which are securely installed to said first lower holder and a second lower holder, respectively, and oppositely disposed to define therebetween a space, and a pad member located opposite to said punch and vertically movably disposed in said space, said pad member being always biased upwardly toward said punch, said curved elongate flat sheet metal being placed on said pad member to be pressed against said first and second press dies and said pad member at its lower-most position, the distance between the lower surface of said press plate and the upper surface of said curved elongate flat sheet metal placed on said punch plate being approximately equal to the distance of a stroke of said pad member when said punch is in contact with said curved elongate flat sheet metal placed on said pad member at its upper-most position.

8. A press forming apparatus as claimed in claim 7, wherein said punch has a width which is smaller than that of said pad member by about two times thickness of said curved elongate flat sheet metal.

9. A press forming apparatus as claimed in claim 7, further comprising a plurality of cushion pins for always biasing said pad member to upwardly toward said punch of said upper press element.

* * * * *